US008037916B2

(12) United States Patent
Symens et al.

(10) Patent No.: US 8,037,916 B2
(45) Date of Patent: Oct. 18, 2011

(54) TIRE LABELING SYSTEM

(75) Inventors: Ronald Symens, Massillon, OH (US); Richard Delmoro, Tallmadge, OH (US)

(73) Assignee: Commercial Time Sharing Inc., Akron, OH (US)

( * ) Notice: Subject to any disclaimer, the term of this patent is extended or adjusted under 35 U.S.C. 154(b) by 837 days.

(21) Appl. No.: 10/590,449

(22) PCT Filed: Feb. 28, 2005

(86) PCT No.: PCT/US2005/006546

§ 371 (c)(1),
(2), (4) Date: Jul. 30, 2007

(87) PCT Pub. No.: WO2005/084294

PCT Pub. Date: Sep. 15, 2005

(65) Prior Publication Data

US 2007/0295447 A1 Dec. 27, 2007

Related U.S. Application Data

(60) Provisional application No. 60/548,549, filed on Feb. 27, 2004.

(51) Int. Cl.

| | |
|---|---|
| ***B29C 65/56*** | (2006.01) |
| ***B29D 30/26*** | (2006.01) |
| ***B32B 37/02*** | (2006.01) |
| ***B32B 37/10*** | (2006.01) |
| ***B32B 38/14*** | (2006.01) |
| *B32B 37/12* | (2006.01) |
| *B32B 38/10* | (2006.01) |
| *B32B 38/18* | (2006.01) |

(52) U.S. Cl. ..... 156/408; 156/247; 156/285; 156/421.6; 156/DIG. 24; 156/DIG. 34; 156/DIG. 38

(58) Field of Classification Search ..... 156/408, 156/421.6, DIG. 24–DIG. 49; 211/19, 20, 211/23

See application file for complete search history.

(56) References Cited

U.S. PATENT DOCUMENTS

| | | | | |
|---|---|---|---|---|
| 5,264,066 | A | 11/1993 | Lundell | 156/361 |
| 5,277,742 | A * | 1/1994 | Scheurer | 156/397 |
| 5,527,407 | A | 6/1996 | Gartland et al. | 156/64 |
| 6,144,033 | A | 11/2000 | Kokubu et al. | 250/358.1 |
| 6,510,996 | B1 * | 1/2003 | Lee et al. | 235/462.01 |
| 7,338,914 | B2 * | 3/2008 | Conwell et al. | 442/149 |
| 2002/0174939 | A1 * | 11/2002 | Caretta et al. | 156/118 |
| 2005/0274269 | A1 * | 12/2005 | Nishimoto et al. | 101/288 |

FOREIGN PATENT DOCUMENTS

| | | | |
|---|---|---|---|
| EP | 1 504 881 | | 2/2005 |
| JP | 2003-200721 | | 7/2003 |
| JP | 2003200721 | A * | 7/2003 |
| JP | 2003221021 | A * | 8/2003 |
| JP | 2003-221021 | | 8/2005 |

* cited by examiner

*Primary Examiner* — Sonya Mazumdar
(74) *Attorney, Agent, or Firm* — Renner Kenner Greive Bobak Taylor & Weber

(57) ABSTRACT

A tire labeling system (10) for printing a label (L) and applying the label (L) on a surface of a tire (T). A printer (12) is provided to print the label and an applicator (20) is provided to transfer the label (L) from the printer (12) to the tire (T) and apply the label (L) to the tire (T).

11 Claims, 7 Drawing Sheets

TIRE LABELING SYSTEM

RELATED PATENT APPLICATIONS

This is a §371 application of PCT/US2005/006546 filed Feb. 28, 2005, which claims the benefit of U.S. Provisional Application No. 60/548,549 filed on Feb. 27, 2004; wherein both applications are expressly incorporated herein by reference.

TECHNICAL FIELD

In general, the present invention relates to a tire labeling system. More particularly, the present invention relates to a tire labeling system that picks up a label from a printer moves to a selected position, and applies the label to a tire.

BACKGROUND OF THE INVENTION

Tire labels are applied to all new tires and contain information about the tire's characteristics and other information required by law. To save costs, large quantities of labels are printed on rolls that are shipped to manufacturing facilities to be applied to the tires. The preprinted labels are loaded into a labeling machine located adjacent to a conveyor. As tires travel on the conveyor, they are brought into contact with a label at a point where the backing has been stripped away from the label allowing the label to be applied by contacting the tire to the exposed adhesive on the label.

As new performance data becomes available that affects the characteristics listed on the labels, new labels must be printed and shipped to the manufacturers and dealers to update those tires that had previously been labeled. The old label must be removed, and, due to the strong adhesive used to make sure the label does not come off during shipment, it is often difficult to completely remove the label before applying a new one.

At times, test data will become available that affects the characteristics of the tire listed on the label before the previously sent labels have been applied. In these cases, entire shipments of labels are scrapped. When viewed in the context of the extremely large number of tires produced and sold, the cost of replacing labels and scrapping old labels becomes significant, and may be on the order of millions of dollars.

Consequently, there is a need for a tire labeling system that can provide the printed information on the label on a per label basis. There is a further need for a tire labeling system that may be used to apply labels in an automated fashion.

SUMMARY OF THE INVENTION

In general, a tire labeling system for printing a label on a per label basis and applying the label on a surface of a tire includes a printer that receives tire information and prints this information on a label is provided along with an applicator that transfers the printed label from the printer to the tire and applies the label to the tire.

In accordance with at least one aspect of the present invention, the present invention further provides a tire labeling system made in accordance with one aspect of the present invention includes an applicator configured to receive the label for placement on a tire, and a frame carrying the applicator, the frame facilitating movement of the applicator along a first axis, a second axis, and a third axis, and including at least one first guide for moving the applicator along the first axis, a second guide supported by the at least one first guide for moving the applicator along the second axis, and a third guide supported by the second guide for moving the applicator along the third axis.

In accordance with another aspect of the present invention, a tire labeling system includes an applicator, and a frame carrying the applicator, the applicator including a head and an arm supporting the head, the arm being rotatably mounted relative to the frame, and rotatable between a pick-up position and at least one application position, and the frame facilitating movement of the application along a first axis, a second axis, and a third axis.

In accordance with still another aspect of the present invention, a tire labeling system for printing labels, removing labels from a backing, and positioning labels on the surfaces of tires including a printer for printing labels, a platform receiving the labels, a take-up spool for gathering the backing, an applicator, and a frame carrying the applicator, the frame facilitating movement of the applicator along a first axis, a second axis, and a third axis.

In accordance with yet another aspect of the present invention, a method for applying printed labels to the surfaces of tires includes the steps of supplying tire information regarding tires to a computer, instructing a printer to print the tire information on labels, and using an applicator to remove the label from the printer and apply the label to the tire.

DETAILED DESCRIPTION OF THE INVENTION

Figure 1:
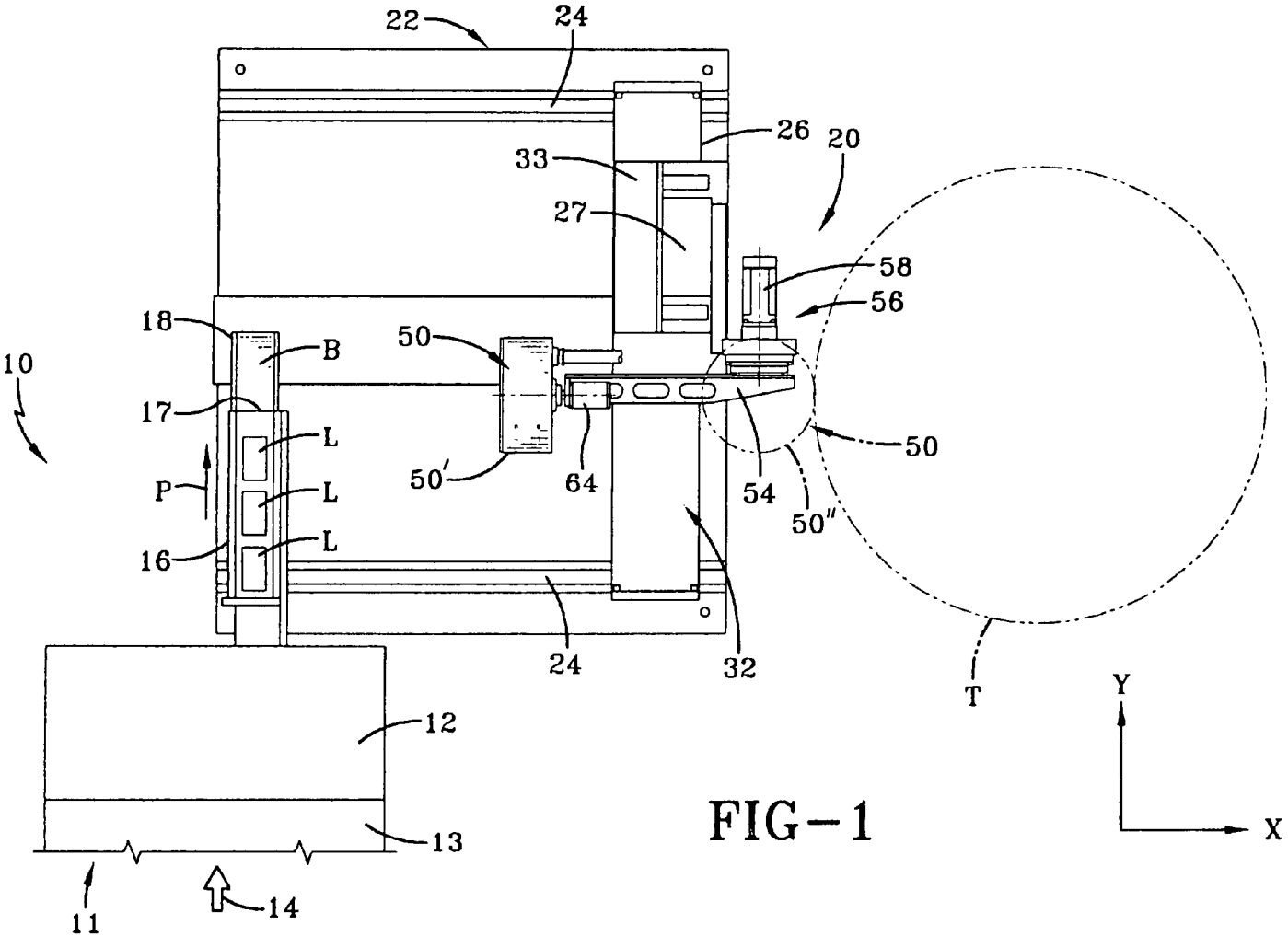
FIG. 1 is a top plan view of a tire labeling system according to the concepts of the present invention depicting a frame supporting an applicator positioned adjacent a printer system.
Figure 3:
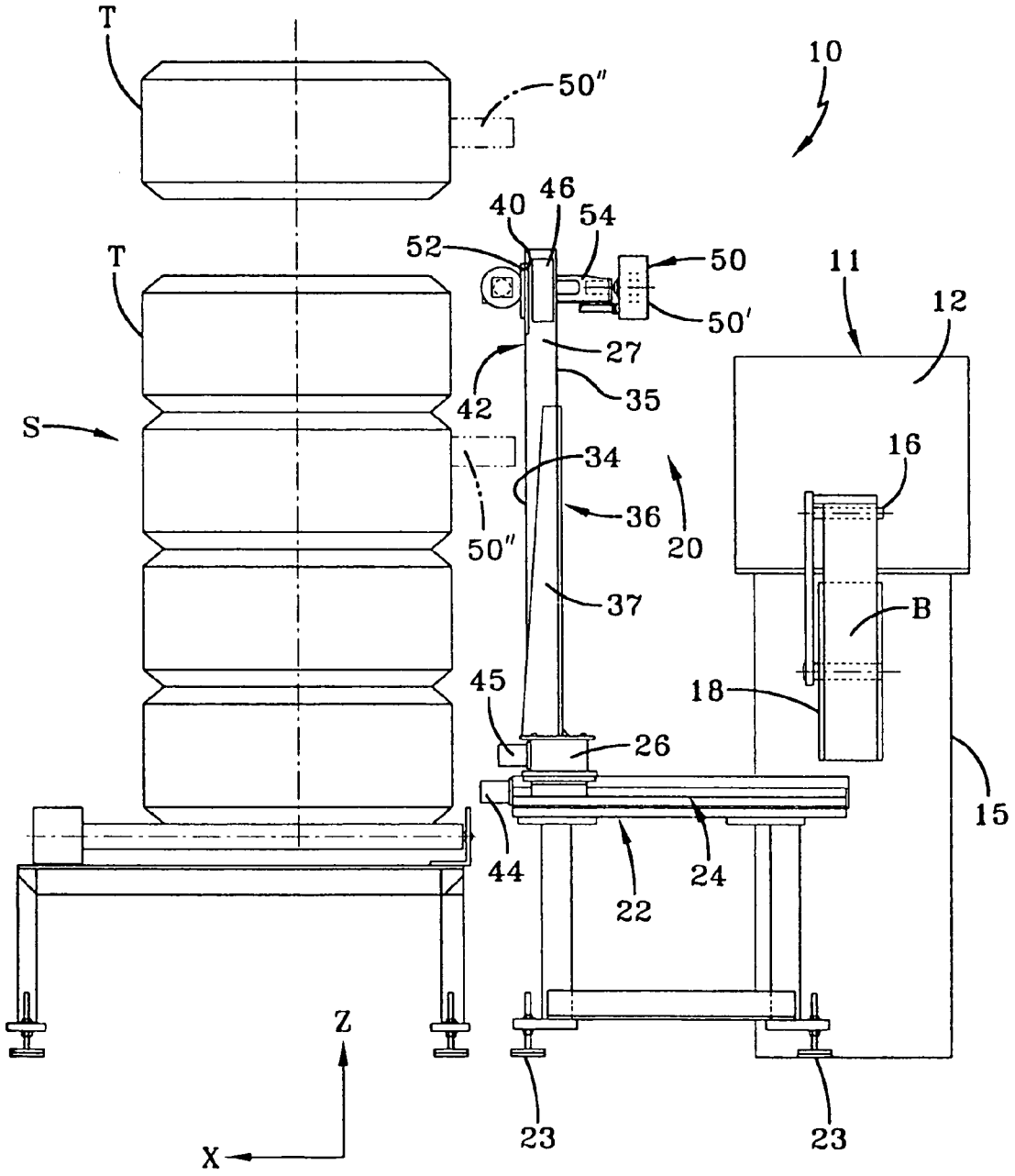
FIG. 3 is a right side elevational view of the tire labeling system of FIG. 1 positioned adjacent a conveyer carrying tires.

A tire labeling system according to the concepts of the present invention is generally indicated by the numeral 10 in FIGS. 1 and 3. The tire label system 10 may include a printer assembly, generally indicated by the numeral 11 that includes a printer 12 connected to a computer, generally indicated by the numeral 13, that provides tire information 14 to the printer 12.

Figure 4:
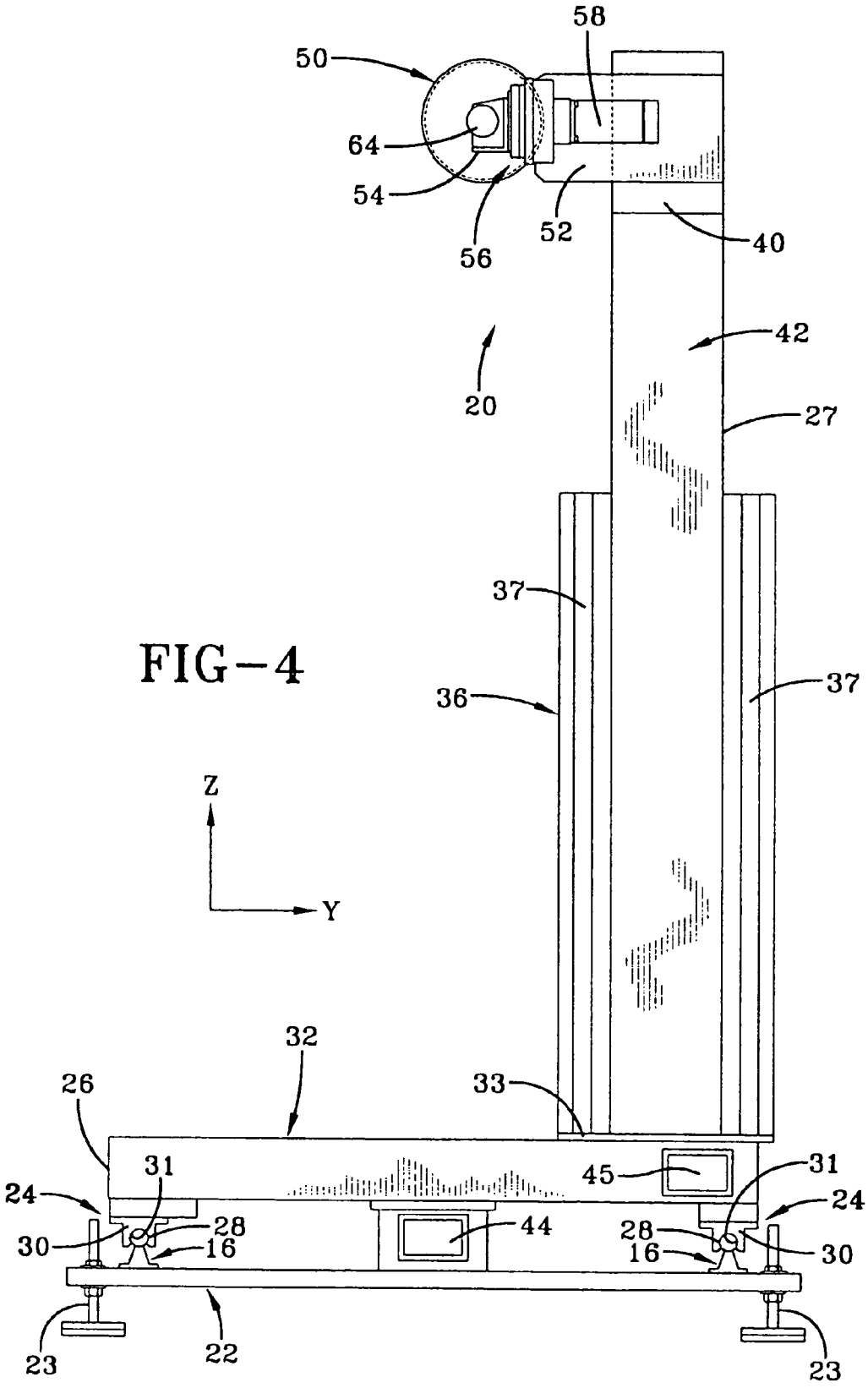
FIG. 4 is an enlarged left side elevational view of the frame supporting the applicator depicted in FIG. 1.

As shown in FIGS. 1, 3 and 4, the computer 13 may be any device suitable for storing the tire information 14 for tires T, and, thereafter, providing that information to the printer 12. The tire information 14 may be loaded on the computer 13 by any known method including portable memory storage devices, such as floppy disks, compact disks, flash memory drives, portable hard drives, and the like, by a network connection with an appropriate database, or based on input from any manual or automated scanning device that reads the tire information 14 from the tires T. It will be appreciated that the printer 12 and computer 13 may be integrated into a single unit. Since such devices are well known, the printer 12 and computer 13 are generically represented by boxes in the accompanying drawings.

As shown in FIGS. 1, 3 and 4, the printer 12 and computer 13 are in electrical communication to allow transmission of the tire information 14 from the computer 13 to the printer 12. The computer 13 will also be provided with the position of the individual tires T within a stack S (FIG. 4) to allow the application of a label L to a specific tire T, as will be described more completely below.

The tire information 14 is transmitted to the printer 12, and then printed onto the labels L on a per label basis. In other words, each of the labels L is printed just before it is applied to its associated tire T. In this way, if characteristics of the tires T change, and such changes require that information printed on the labels L be changed, the computer 13 may be updated, and the printer 12 can print new labels without having to scrap an entire roll of labels.

The printer 12 may be mounted on a printer frame 15 serves as a pedestal, and include a platform 16 where the backing B is removed from the label L exposing the label's adhesive side. In the example shown, the backing B is directed downwardly from the edge 17 of the platform 16, and would around a take-up spool 18 on which the empty backing B is gathered. As the backing B extends downward from the edge 17, the label L is at least partially freed from the backing B, such that it may be picked-up by an applicator, generally indicated by the numeral 20, as will be described more completely below.

Figure 2:
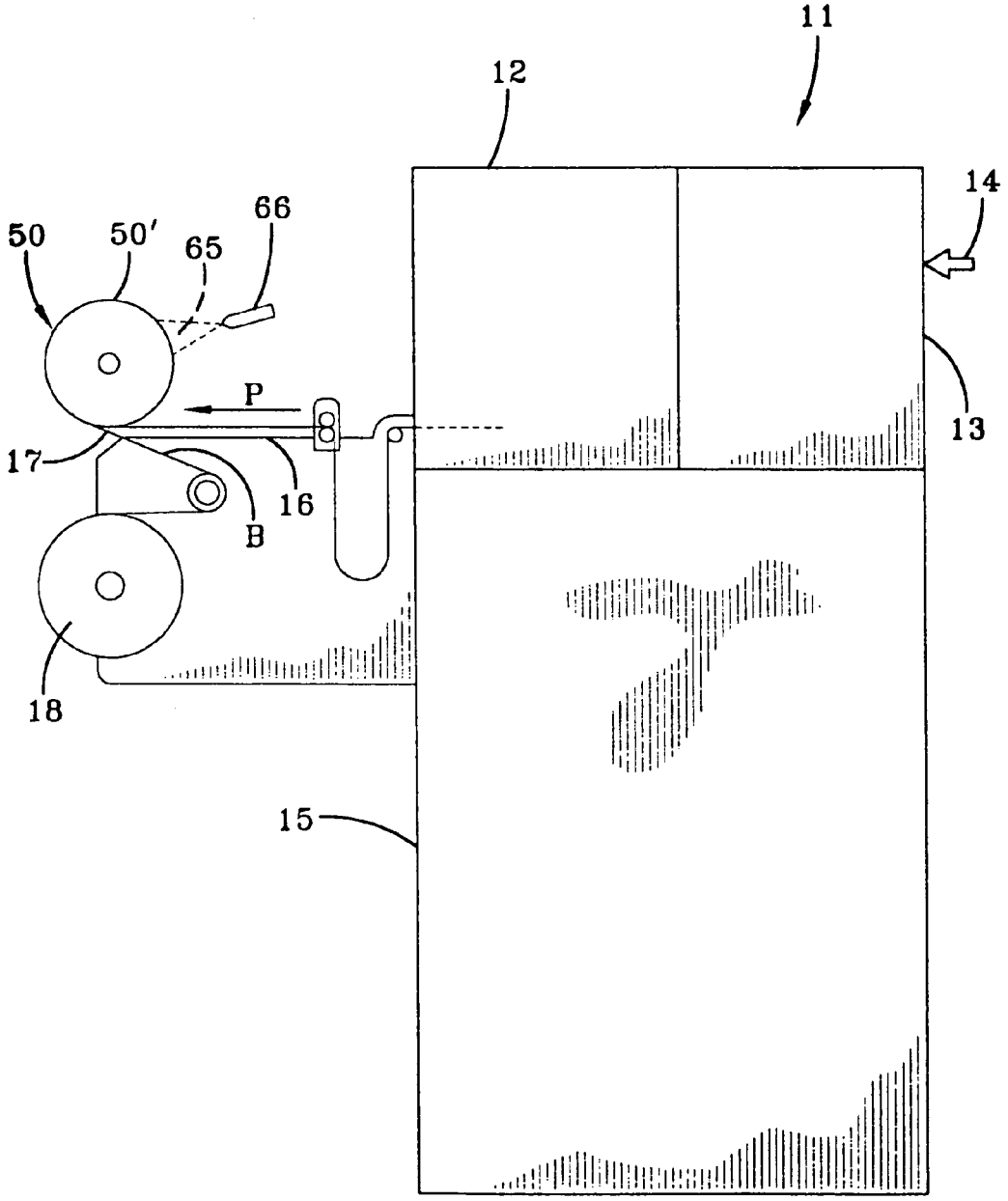
FIG. 2 is rear elevational view of the printer system of FIG. 1.
Figure 5:
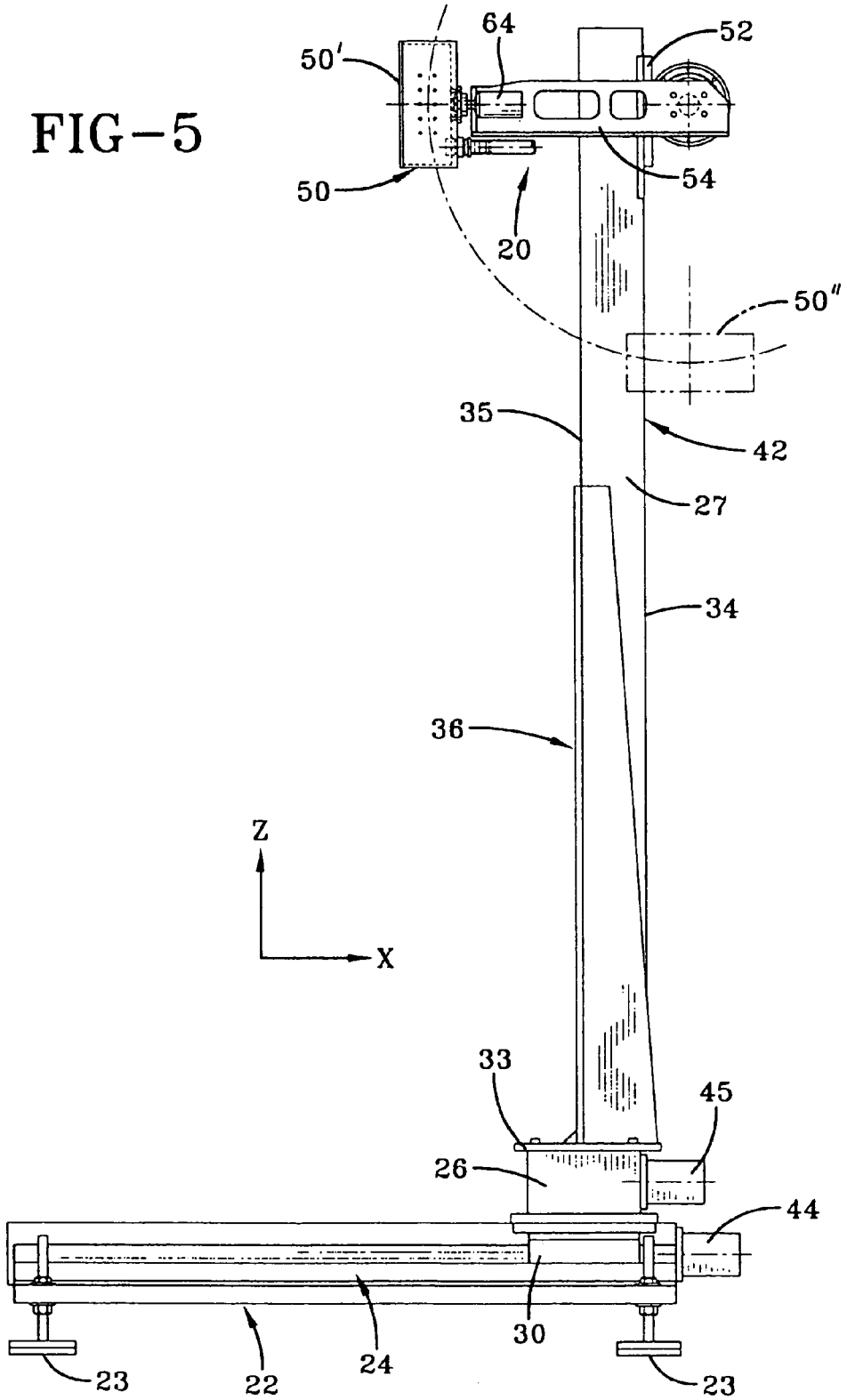
FIG. 5 is an enlarged front elevational view of the frame supporting applicator depicted in FIG. 1.
Figure 6:
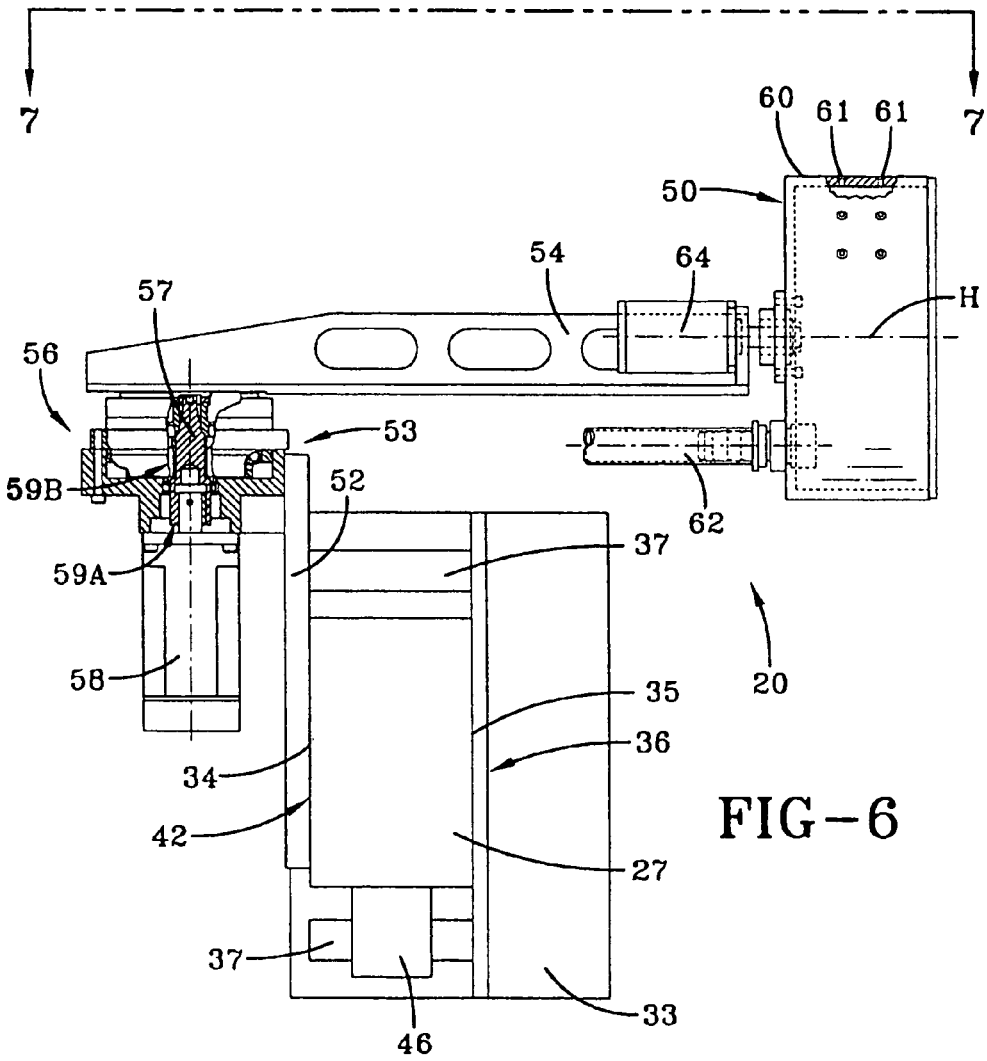
FIG. 6 is an enlarged plan view of the applicator of FIG. 1 showing an arm and an applicator head attached to the arm supported on a post.

As best shown in FIGS. 2, 5 and 6, the applicator 20 is mounted on a frame, generally indicated by the numeral 22, and made moveable to transfer labels L from the printer assembly 11 to the tires T. The frame 22 may be mounted on adjustable feet 23 (FIGS. 4, 5 and 6) that may be used to level the applicator 20. As will be explained in more detail below, applicator 20 may be made movable on the frame 22 along plural axes, for example, the x, y, and z axes shown in FIGS. 5 and 6. The labeling of these axes in the drawings is arbitrary and, thus, should not be considered limiting, when considering the applicator's movement relative to frame 22. To provide for such movement, the frame 22 includes guides 24, 32, 42, described more completely below, that allow movement along the x, y, and z axes, respectively.

The first guides 24 may extend perpendicular to a label path P on opposite sides of the frame 22. The first guides 24 provide for movement of the applicator 20 along the x-axis. For example, a cross member 26 is slidably supported on the first guides 24 for movement in the x direction. As best shown in FIGS. 5 and 6, the cross member 26 carries a post 27 on which the applicator 20 is mounted. In this way, the applicator 20 may be moved toward and away from the labels L or tires T along the first guides 24.

The first guides 24 may be any member or members adapted to permit movement of the cross member 26 in a direction perpendicular to the label path P. For example, the first guides 24 may include tracks, rails, grooves, linear tables, or shafts, among others. In the example shown, the first guides 24 are rails each having a generally cylindrical bearing surface 28 on which slides 30 are received. The slides 30 extend downwardly from either end of the cross member 26, and defining semicircular recesses 31 that receives the cylindrical bearing surfaces 28 of the first guides 24.

The post 27 may be moveable along the cross member 26 in the y direction. To that end, the cross member 26 may be provided with a second guide 32 similar to the first guides 24. It will be appreciated that the variety of guides described above may be used to the same effect to allow movement of the cross member 26 along the y-axis.

In the example shown, the second guide 32 is a linear table that generally makes up the cross member 26, and includes a plate 33 movable along the second guide 32 in the y direction. The plate 33 carries the post 27, and thus, in addition to being moveable in the x direction along the first guides 24, the post is moveable in the y direction along the second guide 32.

As shown in FIGS. 5 and 6, the post 27 extends upwardly from the plate 33, and includes a front surface 34 and a rear surface 35. The front surface 34 and rear surface 35 are parallel to the z-axis, and the rear surface 35 may be centered on the plate 33. The post 26 may be a relatively thin member, and a support member 36 including suitable gussets 37 may be provided to support the post 27 along its height.

As best shown in FIG. 5, a carriage 40 may be supported on post 27 and be movable, in the z direction, to selected positions. As in the previous embodiments, a guide, in this case third guide 42, may be provided for the movement of the carriage 40. In the example shown, the third guide 42 is a linear table that generally forms the post 27, and the carriage 40, as discussed above, is moveable along the third guide 42 in the z direction.

Movement of the cross member 26 along the first guides 24, of the plate 33 supporting the post 27 along the second guide 32, and of the carriage 40 along the third guide 32 may be effectuated by various actuators including pneumatic, hydraulic, belt, servo, screw, or other drives. In the example shown, first, second, and third servo motors 44, 45, 46, as shown in FIG. 1, are used to drive screws that position the applicator 20 in the x, y, and z directions, respectively. In particular, the first servo motor 44 drives cross member 26 along the first guides 24 in the x direction; the second servo motor 45 drives plate 33 and the post 27 attached to the plate 33 along the second guide 32 in the y direction; and the third servo motor 46 moves the carriage 40 along the third guide 42 in the Z direction. As a result, the applicator 20 may be moved to pick-up labels L on one side of the tire labeling system 10, and, thereafter, transport them in the x direction toward the tires T. Once adjacent the stack S of tires T, the applicator 20 can be moved in the y direction to adjust its horizontal orientation and moved in the z direction to adjust its vertical orientation to locate the labels L adjacent to the appropriate tire T, within the stack S, and, finally, move in the x direction to apply the labels L to the surface of the tire T.

To pick-up the labels L, applicator 20 is provided with a head, generally indicated by the numeral 50. The head 50 may be moved from a pick-up position 50' oriented parallel to the label path P, which may be horizontal, as shown, and moved to application positions 50" parallel to the surface of tire T to apply the label L to tire T. In the example shown, the tires T are stacked vertically, and thus, the head 50 may be vertically oriented in one of two application positions 50" to apply labels L. As shown in FIG. 4, the head 50 may be rotated to either an upward or a downward application position 50".

Figure 7:
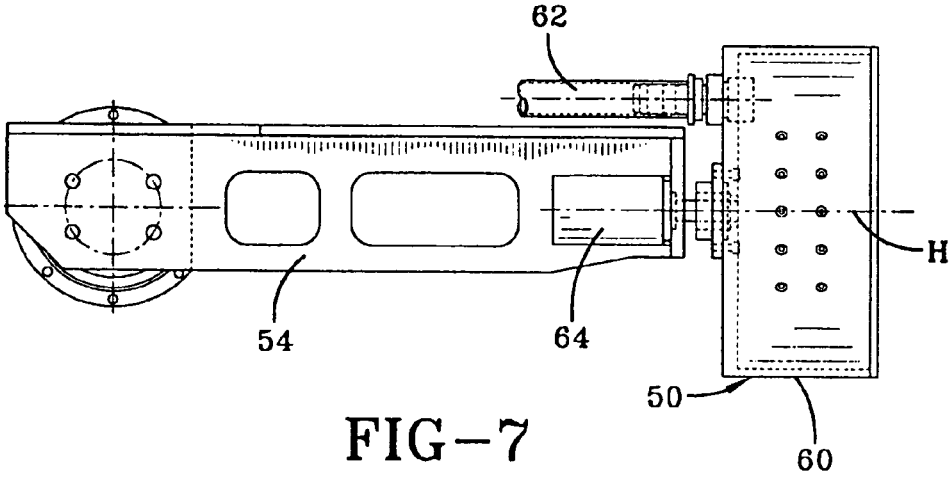
FIG. 7 is a right side elevational taken along Line 7-7 of FIG. 6 showing the arm and the applicator head attached to the arm.

As shown in FIG. 7, the applicator 20 may include a bracket 52 that attaches to the carriage 40. The head 50 may be mounted on a lateral side 53 of bracket 52 outward of post 27, such that, the post 27 does not inhibit the rotational movement of the head 50. As shown, head 50 is mounted on an arm 54 that rotates via a shaft support assembly 56 and a pivot shaft 57 supported by the shaft support assembly 56 to move the head 50 between the pick-up position 50' and application position 50".

As best shown in FIG. 7, the pivot shaft 57 is supported within the shaft support assembly 56, and is driven by a motor 58, which, like motors 44, 45, and 46, may be a servo motor. The shaft support assembly 56 may include a coupling 59A to attach the pivot shaft 57 to the motor 58. To absorb countertorque on pivot shaft 57 caused by the head 50 contacting tire T, the coupling 59A may be a spring coupling. Furthermore, the shaft support assembly 56 may include bushings or bearings 59B to rotatably support the pivot shaft 57.

The pivot shaft 57 is keyed or otherwise rotatably fixed to arm 54. As such, rotation of the pivot shaft 57 by the motor 58 results in rotation of the arm 54. In this way, head 50 may be rotated to the pick-up position 50' and application positions 50". If necessary, stops may be provided on bracket 52 to stop the arm 54 as it rotates the head 50 to the pick-up position 50' and application positions 50". The stops may be offset relative to each other to account for the arm 54 being off center relative to the head 50.

To pick-up labels L, a vacuum may be applied at the head 50 to draw the label L from its backing B and onto the head 50. The head 50 may have any shape or configuration suitable for picking up and applying the labels L including flat-surfaced members. In the example shown, the head 50 has a curved surface and is generally cylindrical in shape. As best shown in FIG. 7, the outer surface 60 of the head 50 may be provided with one or more openings 61 through which the vacuum is applied. The openings 61 may be generally cylindrical, and may flare radially outward at the surface 60. The openings 61 may be provided along a portion of surface 60 that corresponds to the length of the label L. While individual openings 61 may be formed in head 50, the head 50 may be provided with a screen (not shown) that allows the vacuum to be drawn therethrough.

The head 50 is connected to a vacuum source (not shown), as by vacuum line 62. As such, the vacuum provided by the vacuum source communicates through the interior of the head 50 to the openings 61. To help pull the label L from the backing B, the vacuum may be initially limited to the leading openings 61 initially positioned adjacent the label L, and, thereafter, progressively spread to the trailing openings 61 as the label L is rolled on to the head 50. To that end, head 50 is rotatable on an axis H, and, as shown in FIGS. 7 and 8, a motor 64 is provided to rotate the head 50. Rotation of the head 50 may be limited to the length of the label L. Furthermore, head 50 may be rotated at a speed to peel the label L from the backing B that corresponds with the speed of the label L as it exits the printer 12.

After the label L is peeled away from the backing B, the surface 60 of the head 50 retains the label L thereon with the adhesive side of the label L exposed, and facing outwardly relative to the head 50. It will be appreciated that it may be desirable to apply additional adhesive 65 to the label L. To that end, an adhesive dispenser, generally indicated by the numeral 66 in FIG. 3, may be provided. The adhesive dispenser 66 can be mounted on the printed frame 15, such that additional adhesive 65 may be applied to the label L after it is picked up by the head 50. The adhesive dispenser 66 can be an adhesive sprayer allowing the additional adhesive 65 to be uniformly applied to the adhesive side of the label L.

With the label L on the head 50, the applicator moves along the x, y, and z axes according to instructions from computer 13 to position the label L adjacent the selected tire T. With the head in one of the application positions 50", the applicator 20 is advanced toward the tire T to press the head 50 against the surface of the tire T to sandwich the label L therebetween. The applicator 20 can be configured to detect the force at the head 50, for example, by a torque limit programmed into motors 44, 45, or 46 to avoid over extending the head 50, and damaging the motors 44, 45, and 46. As necessary, after the label L is initially contacted with tire T, the head 50 may be moved along the surface of the tire T to completely apply the label L to the tire T. During this process, the vacuum is released freeing the label L from the head 50. After the label L is applied, the applicator 20 moves to the printer 12 to repeat the pick-up and application process.

In light of the foregoing, it should thus be evident that a tire labeling system according to the concepts of the present invention substantially improves the art. While, in accordance with the patent statutes, only the preferred embodiment of the present invention has been described in detail hereinabove and shown in the accompanying drawings, the present invention is not to be limited thereto or thereby. It will be appreciated that various modifications may be made to the above-described embodiment without departing from the spirit of the invention.

What is claimed is:

1. A tire labeling system for positioning a label on a tire tread surface of a specific tire, wherein the specific tire is maintained within a stack of tires, the tire labeling system comprising, a computer adapted to receive tire information and position information regarding a specific tire within a stack of tires;

a printer receiving the tire information for the specific tire from said computer and printing the tire information on the label;

a single applicator configured to receive the label for placement on a tire tread surface of the specific tire within the stack of tires;

a frame carrying the applicator, the frame receiving the position information so as to direct movement of the applicator along a first axis, a second axis, and a third axis, and including at least one first guide for linearly moving the applicator along the first axis, a second guide supported by the at least one first guide for linearly moving the applicator along the second axis, and a third guide supported by the second guide for linearly moving the applicator along the third axis; and a rotatable arm carried by one of said guides, wherein said rotatable arm is rotatable with respect to one of said axes and wherein said computer instructs said rotatable arm to linearly move along the first, second and third axes so as to pick up a label from said printer with said rotatable arm, and then move said rotatable arm along said axes so as to apply the label to the tire tread surface of the specific tire within the stack of tires.

2. A tire labeling system according to claim 1, wherein the second guide is formed as a cross member, the cross member supported by two first guides for movement along the first axis.

3. A tire labeling system according to claim 2, wherein the third guide is formed as a post, the post supported by the second guide for movement along the second axis.

4. A tire labeling system according to claim 3, wherein a carriage carrying the applicator is supported by the post, the carriage being moveable on the post along the third axis.

5. A tire labeling system according to claim 4, wherein said arm is rotatably attached to the carriage, the arm being rotatable between said pick-up position and at least one application position.

6. A tire labeling system according to claim 5, wherein the applicator includes said rotatable head having a head surface for receiving the label, the head being repositionable, according to movement of the arm, and movement of the applicator along the first axis, the second axis, and the third axis, to pick up the label and apply the label to the tire.

7. A tire labeling system according to claim 6, wherein the head surface includes an opening extending therethrough, and wherein said head is in communication with a vacuum line adapted to selectively apply a vacuum through the opening to pick up the label as instructed by said computer.

8. A tire labeling system according to claim 1, wherein the frame includes a carriage carrying the applicator, the carriage being supported by the third guide for movement along the third axis.

9. A method for applying printed labels to a tread surface of a specific tire, wherein the specific tire is maintained within a stack of tires, comprising:

supplying tire information regarding a tire to a computer including position information of where the specific tire is in a stack of tires;

instructing a printer to print the tire information on a label;

using an applicator on a rotatable arm to remove the label from the printer;

linearly moving the applicator in a first axis, a second axis, and a third axis so as to position the applicator near the specific tire; and rotating the rotatable arm with respect to one of the axes by the applicator so as to apply the label to the specific tire tread surface within the stack of tires.

10. The method of claim 9 wherein the label is made self-adhesive and is mounted on a backing; the method further comprising using the applicator to separate the label from the backing before applying the label to the tire.

11. The method of claim 10 further comprising selectively applying a vacuum to a rotatable head extending from said rotatable arm to separate the label from the backing.

* * * * *